US009103145B2

(12) United States Patent
Hatton

(10) Patent No.: US 9,103,145 B2
(45) Date of Patent: Aug. 11, 2015

(54) CASE LATCH ASSEMBLY

(75) Inventor: James Hatton, St. Leonards-on-Sea (GB)

(73) Assignee: PENN ELCOM LIMITED, St. Leonards-On-Sea (GB)

( * ) Notice: Subject to any disclaimer, the term of this patent is extended or adjusted under 35 U.S.C. 154(b) by 155 days.

(21) Appl. No.: 13/439,906

(22) Filed: Apr. 5, 2012

(65) Prior Publication Data

US 2012/0299312 A1 Nov. 29, 2012

(30) Foreign Application Priority Data

Apr. 6, 2011 (EP) ..... 11161387

(51) Int. Cl.

| | |
|---|---|
| ***E05C 5/00*** | (2006.01) |
| ***E05C 19/14*** | (2006.01) |
| ***E05C 19/10*** | (2006.01) |
| ***E05C 19/12*** | (2006.01) |

(52) U.S. Cl.

CPC ..... *E05C 19/145* (2013.01); *E05C 19/105* (2013.01); *E05C 19/12* (2013.01)

(58) Field of Classification Search

CPC ... E05B 65/52; E05B 65/523; E05B 65/5269; E05C 19/105; E05C 19/14

USPC ..... 292/57, 60, 61, 63, 64, 67, 109, 113, 292/203, 241, 247, 256.69, DIG. 41, 292/DIG. 49

See application file for complete search history.

(56) References Cited

U.S. PATENT DOCUMENTS

| | | | | |
|---|---|---|---|---|
| 2,798,371 | A | 7/1957 | Gehrie | |
| 2,820,995 | A | 1/1958 | Schlueter | |
| 3,083,426 | A | 4/1963 | Neilson | |
| 3,204,993 | A * | 9/1965 | Swanson | 292/111 |
| 3,237,978 | A * | 3/1966 | Swanson | 292/113 |
| 5,461,892 | A | 10/1995 | Hsieh | |
| 5,511,834 | A * | 4/1996 | Willems | 292/203 |
| 2002/0149208 | A1* | 10/2002 | Zamberg | 292/98 |
| 2007/0252058 | A1* | 11/2007 | Drumm | 248/222.12 |
| 2008/0238110 | A1* | 10/2008 | Hatton | 292/203 |
| 2009/0127871 | A1 | 5/2009 | Hollebone | |

FOREIGN PATENT DOCUMENTS

| | | |
|---|---|---|
| EP | 1840307 | 10/2007 |
| GB | 776059 | 6/1957 |
| GB | 2203482 | 10/1988 |
| WO | WO2009047780 | 4/2009 |

* cited by examiner

*Primary Examiner* — Kristina Fulton
*Assistant Examiner* — Christine M Mills
(74) *Attorney, Agent, or Firm* — Gordon & Jacobson, PC

(57) ABSTRACT

A case latch assembly includes a first and second lock mounting parts, a strike plate member provided on the first lock mounting part, a hinge member, and a strike plate engagement member. The hinge member is mounted for pivotable movement on a torsion element arranged to apply torsion to the hinge member to bias the hinge member towards or away from the second lock mounting part. The strike plate engagement member is mounted on the hinge member and is reciprocally moveable between a closed position in which the strike plate engagement member engages with the strike plate member and an open position in which the strike plate engagement member is disengaged from the strike plate member.

6 Claims, 4 Drawing Sheets

CASE LATCH ASSEMBLY

CROSS-REFERENCE TO RELATED APPLICATIONS

This application claims priority from EP 11161387.3, filed Apr. 6, 2011, which is hereby incorporated by reference herein in its entirety.

BACKGROUND OF THE INVENTION

1. Field of the Invention

The present invention relates to a case latch assembly.

2. State of the Art

Case latches for securing the lid and body of a case together are well known and typically comprise first and second parts of a split dish, each part being externally mounted respectively on the body and lid of a case. The first part is typically provided with a rotatably mounted hinge plate comprising a slider element moveably mounted on the hinge plate. The slider element comprises a latch hook and is arranged to move by means of an actuator. A catch plate is provided on the second part of the split dish, and the latch hook is adapted to hook onto the catch plate, and hold the case closed. To open the latch, the actuator is operated by a user to move the latch hook out of engagement with the catch plate, and the hinge plate may then be rotated by the user so that the latch hook is swung up and away from the catch plate to allow the case to be opened.

SUMMARY OF THE INVENTION

According to an aspect of the present invention there is provided a case latch assembly comprising:

a first lock mounting part;

a second lock mounting part;

a strike plate member provided on the first lock mounting part;

a hinge member mounted for pivotable movement on a torsion element, the torsion element being arranged to apply torsion to the hinge member to bias the hinge member towards or away from the second lock mounting part; and a strike plate engagement member mounted on the hinge member and being reciprocally moveable between a closed position in which the strike plate engagement member engages with the strike plate member and an open position in which the strike plate engagement member is disengaged from the strike plate member.

When the torsion element is arranged to apply torsion to the hinge member to bias the hinge member towards the second lock mounting part this may provide improved resistance to unwanted movement of the hinge member from unexpected external impulses. It may also enable the strike plate engagement member to engage with the strike plate without requiring a user to apply downwards force. When the torsion element is arranged to apply torsion to the hinge member to bias the hinge member away from the second lock mounting part this may assist with moving the strike plate engagement member away from the strike plate during opening of the latch. This may also enable the strike plate engagement member to engage the strike plate member even when there is a gap between the first and second lock mounting parts. This may also ensure that the strike plate engagement member remains engaged with the strike plate when the latch is closed. The latch may therefore be constructed without a separate spring, such as a leaf spring, to push the strike plate engagement member away from the second lock mounting part, thus simplifying the construction of the latch.

In an embodiment, the torsion element comprises a torsion spring and a key element extending generally outwardly from the torsion spring and arranged to engage with an engagement slot provided on the hinge member. The key element provides transfer of torsional force from the torsion spring to the hinge member. The angular position of the key element on the torsion spring may be selected to control the amount of torsional force which is transferred to the hinge member.

In an embodiment, the hinge member is provided with a hook generally at one end thereof, the hook being arranged to couple substantially around the torsion spring and the hook further defining the engagement slot. This may enable the hinge member to be both coupled to the torsion spring and to provide engagement of the hinge member with the key element through a single element.

In an embodiment, the case latch assembly further comprises a mounting element provided on the second lock mounting part and the torsion spring comprises a fixing part and a hinge mounting part on which the key element is provided and wherein the fixing part is coupled to the mounting element and the hinge member is mounted on the hinge mounting part such that the key element is engaged with the engagement slot.

In an embodiment, the strike plate engagement member is mounted for reciprocal linear movement on the hinge member.

In an embodiment, the hinge member further comprises an actuator arranged to cause said reciprocal linear movement of the strike plate engagement member on the hinge member.

In an embodiment, the torsion element is arranged to provide a torsion biasing force to bias the hinge plate towards the second lock mounting part. This may enable the hinge member to be biased towards the second lock mounting part when the strike plate engagement member is in the closed position.

In an embodiment, the case latch assembly further comprises a resilient member arranged to extend towards the strike plate engagement member, the resilient member being arranged such that as the strike plate engagement member is moved towards the open position the resilient member acts to bias the strike plate engagement member away from the second lock mounting part.

In an embodiment, the case latch assembly further comprises a ramp element provided on the strike plate engagement member and the resilient member is arranged such that as the strike plate engagement member is moved towards the open position the ramp element engages with the resilient member and the resilient member acts to bias the strike plate engagement member away from the second lock mounting part.

In an embodiment, the torsion element is arranged to provide a torsion biasing force to bias the hinge plate away from the second lock mounting part. This may enable the hinge member to be biased away from the second lock mounting part both when the strike plate engagement member is in the closed position and when the latch is being opened.

In an embodiment, the first and second lock mounting parts comprise respective first and second mounting dishes, the first and second mounting dishes together comprising a latch dish. This may enable the first and second mounting dishes to be received by respective recesses in a case so that the case latch assembly is mounted substantially flush with a surface of the case.

DETAILED DESCRIPTION OF THE PREFERRED EMBODIMENTS

Figure 1:
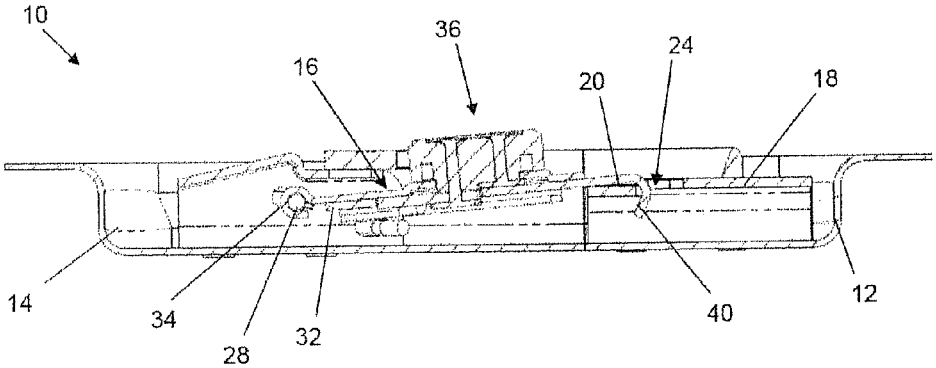
FIG. 1 is a diagrammatic sectional representation of a case latch assembly according to a first embodiment of the invention, in a locked condition.

Referring to FIGS. 1 to 4, a first embodiment of the invention provides a case latch assembly 10 comprising a first lock mounting part 12, a second lock mounting part 14, a hinge member 16, a strike plate member 18 and a strike plate engagement member 20.

The first 12 and second 14 lock mounting parts each comprise a mounting dish. The mounting dishes 12, 14 together form a latch dish and are arranged to be respectively located on the lid and body of a case. Each mounting dish 12, 14 is arranged to be located in a respective aperture (not shown) in the case (not shown) so that the mounting dishes 12, 14 may be mounted substantially flush with a surface of the case.

The strike plate member 18 is mounted on the first mounting dish 12 and defines a strike plate aperture 24.

The torsion element comprises a torsion spring 28, with a key element 22 provided on the torsion spring. In this example, the key element 22 comprises a tab extending generally outwardly from the spring 28. A mounting element 26 is provided on the second mounting dish 14 and comprises first and second mounting apertures 30, each arranged to receive and couple respective ends of the torsion spring 28.

The hinge member 16 comprises a hinge body 32 and a mounting hook 34 provided at one end of the hinge body 32. The mounting hook 34 defines an engagement slot 35 and the hinge member 16 is mounted on the torsion spring 28 with the mounting hook closely receiving and substantially coupling with the spring 28 such that the tab 22 is engaged with the engagement slot. The mounting hook 34 enables the hinge member 16 to be both coupled to the torsion spring 28 and to provide engagement of the hinge member 16 with the tab 22 through a single element. The mounting hook 34 is located around the torsion spring 28 such that the hinge body 32 is mounted for generally pivotable movement about the axis of the torsion spring 28.

The torsion spring 28 and the tab 22 are arranged to provide a torsion biasing force to bias the hinge member 16 away from the second mounting dish 14. The tab 22 is arranged to provide transfer of torsional force from the torsion spring 28 to the hinge body 32, to bias the hinge body away from the second mounting dish 14. It will be appreciated that the angular position of the tab 22 on the spring 28 may be selected to control the amount of torsional force that is transferred to the hinge body 32.

The strike plate engagement member 20 is mounted for reciprocal linear movement on the hinge body 32. The case latch assembly 10 further comprises an actuator 36 provided on the hinge member 16. The actuator 36 is selectively operable by a user, by rotation of an operating key 38, to cause linear movement of the strike plate engagement member 20 with respect to the hinge body 32. The actuator 36 is of a type which will be well known to the person skilled in the art and therefore will not be described in detail here.

The strike plate engagement member 20 comprises a strike plate hook 40 at the opposite end to the mounting hook 34. The strike plate engagement member 20 is reciprocally linearly moveable between a closed position in which the strike plate hook 40 may engage with the strike plate member 18, through the strike plate aperture 24, and an open position in which the strike plate hook is removed from the strike plate member 18. When the strike plate engagement member 20 is in the closed position and engaged with the strike plate member 18, the first 12 and second 14 mounting dishes are brought into a generally adjacent arrangement and are locked together.

Figure 2:
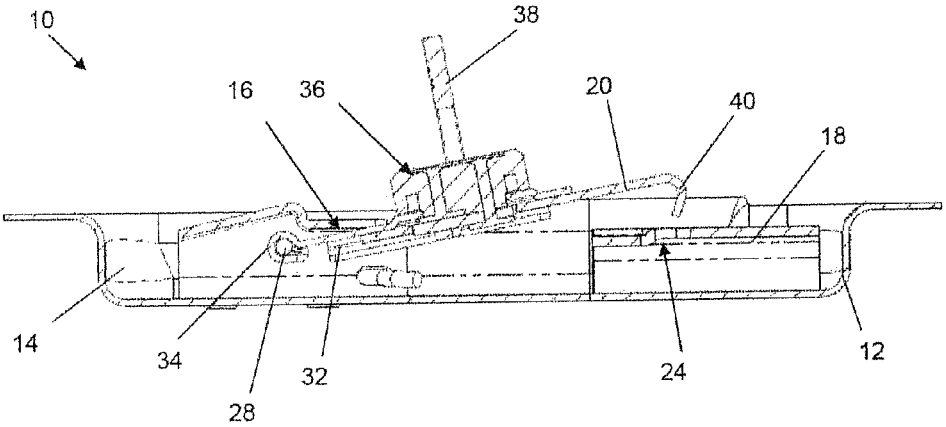
FIG. 2 is a sectional view of the case latch assembly of FIG. 1 in an unlocked condition.
Figure 3:
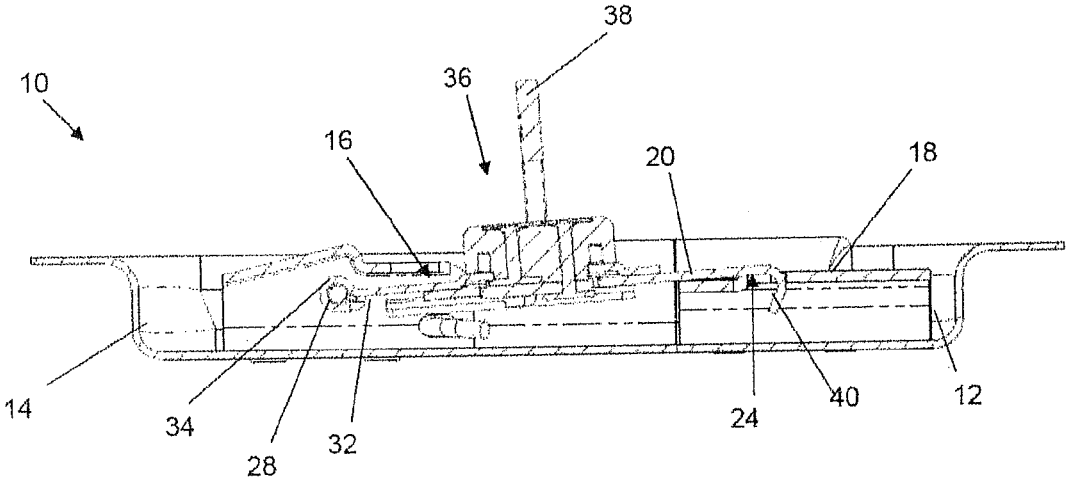
FIG. 3 is a sectional view of the case latch assembly of FIG. 1 in an unlocked condition, with the strike plate engagement member pushed down.
Figure 4:
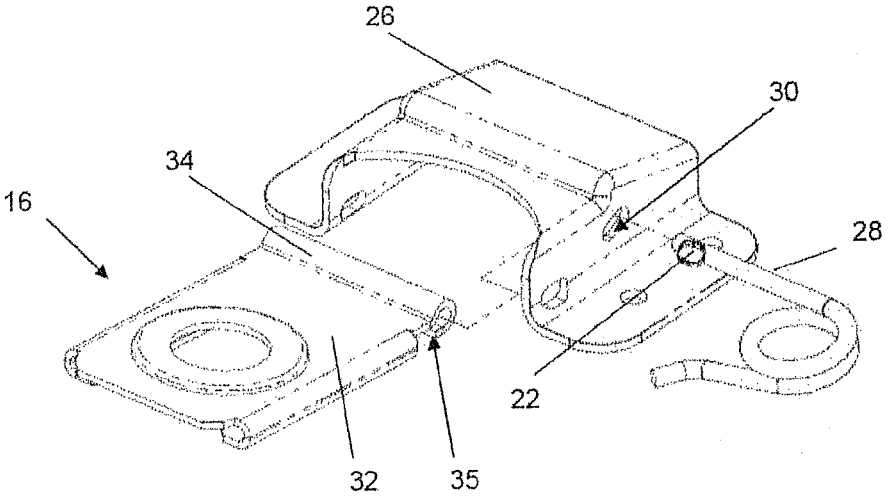
FIG. 4 is an exploded view of the mounting element and torsion spring of the case latch assembly of FIG. 1.

In use, the case latch assembly 10 is unlocked by a user manually operating the actuator 36 which causes the strike plate engagement member 20 to move from the closed position to the open position, shown in FIG. 2. The hinge member 16 is pivoted upwards (as orientated in the drawings) under the upwards force of the torsion spring 28, to move the strike plate hook 40 out of and away from the strike plate aperture 24, and thus disengage from the strike plate member 18. In order to lock the assembly 10 from the open position, a user may apply a manual downwards force, to overcome the upwards force applied by the torsion spring 28, to move the hinge member 16 towards the second mounting dish 14 whilst operating the actuator 36 to move the strike plate engagement member 20 from the open position to the closed position.

Figure 5:
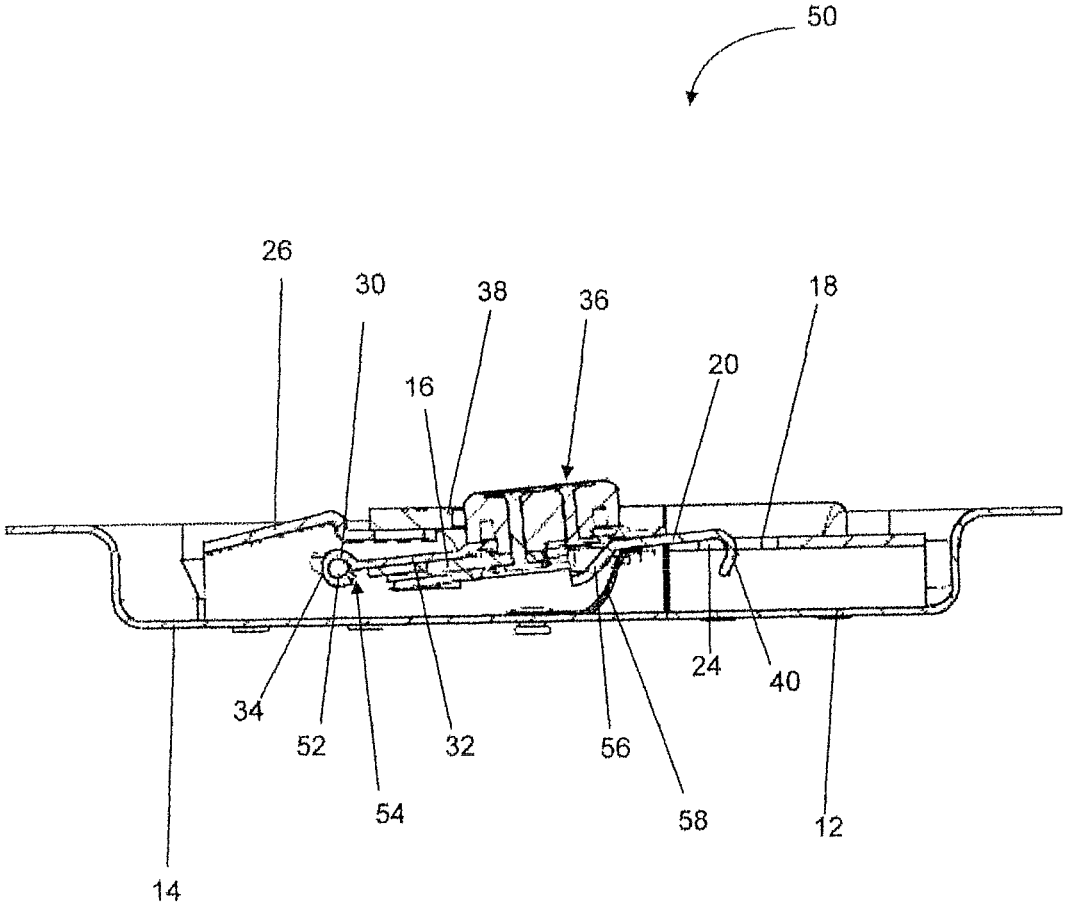
FIG. 5 is a diagrammatic sectional representation of a case latch assembly according to a second embodiment of the invention, in a locked condition.
Figure 6:
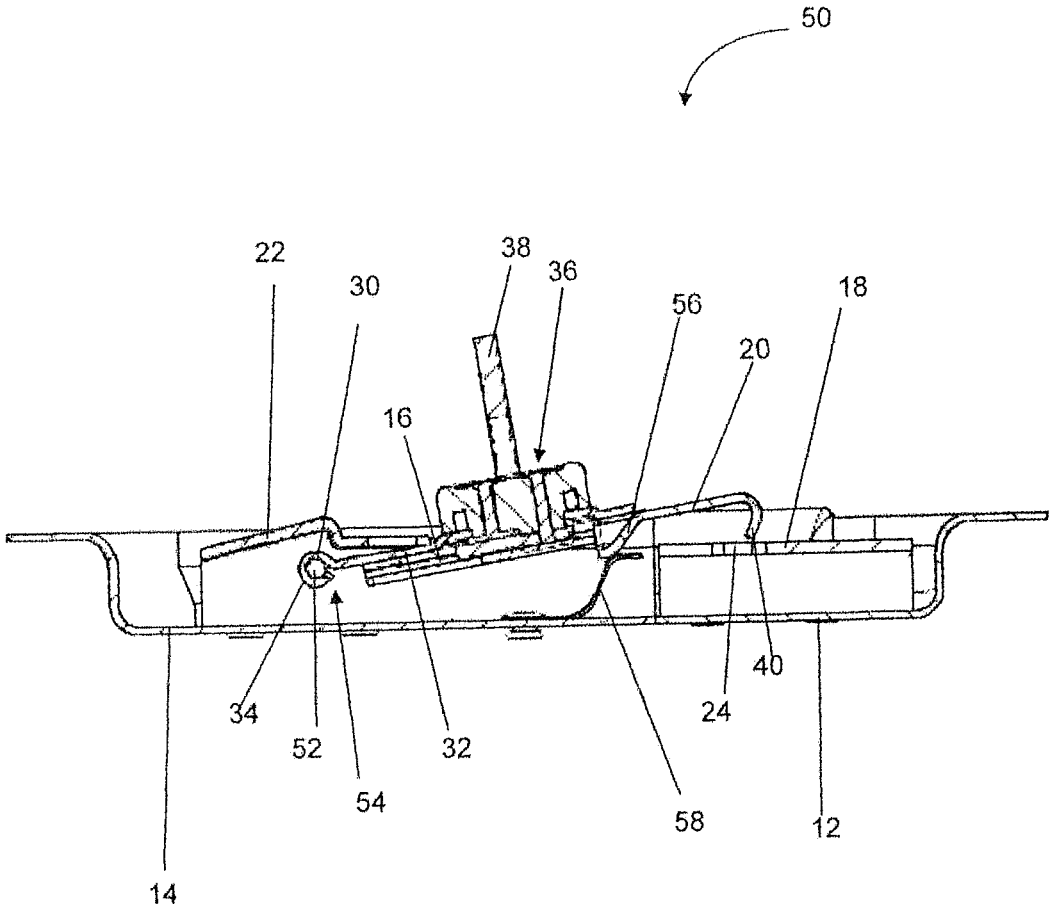
FIG. 6 is a sectional view of the case latch assembly of FIG. 5 in an unlocked condition.

Referring to FIGS. 5 and 6, a second embodiment of the invention provides a case latch assembly 50 which is similar to the case latch assembly 10 of FIGS. 1 to 4, with the following modifications. The same reference numbers are retained for corresponding features.

In this embodiment, the torsion element comprises a torsion spring 52 and a tab 54. The torsion spring 52 is arranged to provide a torsion biasing force to bias the hinge member 16 towards the second mounting dish 14. The tab 54 is arranged to provide additional transfer of torsional force from the torsion spring 52 to the hinge body 32, to bias the hinge body towards the second mounting dish 14. It will be appreciated that the angle of the tab 54 with respect to the mounting hook 34 may be altered to transfer a different amount of torsional force to the hinge body 32.

The strike plate engagement member 20 further comprises a ramp element 56 on one surface thereof, such that the ramp element 56 substantially faces the second mounting dish 14. The ramp element 56 slopes away from the strike plate engagement member 20 in a direction generally towards both the second mounting dish 14 and the mounting hook 34.

The case latch assembly 50 further comprises a resilient member 58 in the form of a generally z-shaped spring. The skilled man will appreciate that any similar resilient member may be used, such as a leaf spring. The z-shaped spring 58 is provided on the second mounting dish 14 such that it extends towards the strike plate engagement member 20. In this example, the spring 58 is located such that it is substantially removed from the ramp element 56 when the engagement member is in the closed position. The z-shaped spring 58 is arranged such that when the strike plate engagement member 20 is moved from the closed position towards the open position the ramp element 56 comes into engagement with the spring 58 and the resulting spring force acts to bias the strike plate engagement member away from the second mounting dish 14, against the downwards action of the torsion spring 52. The ramp element 56 and the spring 58 are arranged such that as the strike plate engagement member 20 moves towards the open position, the spring increasingly engages with the ramp element and causes a correspondingly increasing spring force on the ramp element. As the latch 50 is opened therefore, the strike plate engagement member 20, and thus the strike plate hook 40, is moved away from the strike plate member 18 and the first mounting dish 12 under the action of the spring 58 and against the downwards force of the torsion spring 52.

In use, the case latch assembly 50 is unlocked by a user manually operating the actuator 36 which causes the strike plate engagement member 20 to move from the closed position to the open position, causing the spring 58 to apply a biasing force onto the strike plate engagement member 20, overcoming the downwards force applied by the torsion spring 52, causing the strike plate hook 40 to move out of and away from the strike plate aperture 24, and thus disengage from the strike plate member 18. In order to lock the assembly 50 from the open position, a user may override the z-shaped spring 58 by applying an additional manual downwards force, in addition to the downwards force applied by the torsion spring 52, to move the hinge member 16 towards the second mounting dish 14 whilst operating the actuator 36 to move the strike plate engagement member 20 from the open position to the closed position.

The z-shaped spring 58 is arranged such that it is substantially removed from the ramp element 56 when the strike plate engagement member 20 is in the closed position. This ensures that when the strike plate engagement member 20 is in the closed position, substantially only the downwards torsion biasing force is acting on the hinge body 32 such that the strike plate engagement member 20 engages with the strike plate member 18. This further ensures that when the strike plate engagement member 20 is in the closed position, there is substantially no upwards spring force acting on the hinge body 32 and the downwards torsion biasing force acts to keep the hinge member 16 biased towards the second mounting dish 14 and therefore the latch assembly 50 locked. The torsion biasing force further acts so as to improve the resistance or shock absorption of the hinge body 32 against unwanted movement from external impulses.

The z-shaped spring 58 is further arranged such that when the strike plate engagement member 20 is moved from the closed position towards the open position the ramp element 56 comes into engagement with the spring 58 and the resulting spring force acts to bias the strike plate engagement member away from the second mounting dish 14, against the downwards force of the torsion spring 52. The ramp element 56 and the spring 58 are arranged such that as the strike plate engagement member 20 moves towards the open position, the spring increasingly engages with the ramp element and causes a correspondingly increasing spring force on said ramp element, such that the upwards spring force increases to a larger magnitude than the downwards torsion biasing force. As the latch 50 is opened therefore, the strike plate engagement member 20, and thus the strike plate hook 40, is urged away from the strike plate member 18 and the first mounting dish 12, under the action of the spring 58, against the downwards force of the torsion spring 52.

There have been described and illustrated herein several embodiments of a case latch assembly. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its scope as claimed.

What is claimed is:

1. A case latch assembly, comprising:

a) a first lock mounting part;

b) a second lock mounting part;

c) a strike plate member provided on the first lock mounting part;

d) a torsion element comprised of a torsion spring having a straight leg portion with a first end and a second end, wherein a tab extends directly outwardly from the first end and a coil portion is formed at the second end;

e) a hinge member mounted for pivotable movement on the torsion element, the torsion element being arranged to apply torsion to the hinge member to bias the hinge member towards or away from the second lock mounting part, the hinge member being provided with a mounting hook generally at one end of the hinge, the mounting hook defining an engagement slot, wherein the mounting hook is arranged to couple about the straight leg portion of the torsion spring and the tab of the torsion spring is arranged to engage the engagement slot; and f) a strike plate engagement member mounted for reciprocal linear movement on the hinge member and being reciprocally moveable on the hinge member between a closed position in which the strike plate engagement member engages with the strike plate member and an open position in which the strike plate engagement member is disengaged from the strike plate member.

2. A case latch assembly as claimed in claim 1, wherein:

the angular position of the tab on the torsion spring is selected to control the amount of torsional force which is transferred to the hinge member.

3. A case latch assembly as claimed in claim 1, wherein:

the torsion element is arranged to provide a torsion biasing force to bias the hinge plate towards the second lock mounting part.

4. A case latch assembly as claimed in claim 3, wherein:

the case latch assembly further comprises a resilient member arranged to extend towards the strike plate engagement member, the resilient member being arranged such that as the strike plate engagement member is moved towards the open position the resilient member acts to bias the strike plate engagement member away from the second lock mounting part.

5. A case latch assembly as claimed in claim 1, wherein:

the torsion element is arranged to provide a torsion biasing force to bias the hinge plate away from the second lock mounting part.

6. A case latch assembly as claimed in claim 1, wherein:

the first and second lock mounting parts comprise respective first and second mounting dishes, the first and second mounting dishes together forming a latch dish.

* * * * *